US005791125A

United States Patent [19]

Kallner

[11] Patent Number: 5,791,125

[45] Date of Patent: Aug. 11, 1998

[54] ROTARY HEAT SEALER AND METHOD THEREFOR

[75] Inventor: David J. Kallner, Coral Springs, Fla.

[73] Assignee: Illinois Tool Works, Inc., Glenview, Ill.

[21] Appl. No.: 876,962

[22] Filed: Jun. 17, 1997

[51] Int. Cl.[6] ..... B65B 51/10

[52] U.S. Cl. ..... 53/477; 53/370.7; 53/373.7; 53/375.9

[58] Field of Search ..... 53/477, 478, 370.7, 53/371.2, 371.6, 550, 371.4, 373.7, 374.2, 374.4, 375.9, 399

[56] References Cited

U.S. PATENT DOCUMENTS

| | | | |
|---|---|---|---|
| 2,803,100 | 8/1957 | Aalseth | 53/374.4 |
| 3,524,301 | 8/1970 | Zimmerman | 53/374.4 |
| 3,572,004 | 3/1971 | Carmichael | 53/375.9 |
| 3,850,780 | 11/1974 | Crawford et al. | 53/373.4 |
| 4,905,446 | 3/1990 | Dieckbernd et al. | 53/374.4 |
| 5,054,269 | 10/1991 | Leino | 53/374.2 |
| 5,088,270 | 2/1992 | Diehl . | |
| 5,423,161 | 6/1995 | Huson et al. . | |
| 5,447,009 | 9/1995 | Oleksy et al. | 53/375.9 |
| 5,628,163 | 5/1997 | Keopple et al. | 53/374.4 |
| 5,687,545 | 11/1997 | Baker | 53/373.7 |

*Primary Examiner*—James F. Coan
*Assistant Examiner*—Gene L. Kim

[57] ABSTRACT

A rotary heat sealer and method therefor useable for thermally sealing overlapping film layers wrapped about a load at a load wrapping station. The rotary heat sealer includes a plurality of heat sealing disks each having a peripherally disposed heating element, and a rotatable shaft disposed through a central opening of the plurality of heat sealing disks, wherein the heat sealing disks are resiliently coupled to the rotatable shaft by spring members so that the heat sealing disks are rotatable with the shaft and the heat sealing disks are independently movable transversely relative to the rotatable shaft axis. The rotary heat sealer is movable toward the load to engage the heating elements thereof with overlapping film layers wrapped about the load to thermally seal an overlapping film tail to underlying film layers, whereby the transversely movable heat sealing disks compensate for variations in the shape of the load, thereby providing improved welding of overlapping film layers.

13 Claims, 2 Drawing Sheets

ROTARY HEAT SEALER AND METHOD THEREFOR

BACKGROUND OF THE INVENTION

The invention relates generally to apparatuses and methods for welding overlapping layers of film material wrapped about a load, and more particularly to heat sealing overlapping film tails to underlying film layers wrapped about loads having irregular or varying surface shapes, wherein the load is moving or stationary.

The wrapping of articles and assemblages of articles on a pallet or otherwise, referred to herein generally as a load, with a stretch film material at a load wrapping station for packaging purposes is well known and used widely with remarkable success. The load is typically moved along a conveyor or by other means to the load wrapping station whereupon stretch film is supplied from a film dispenser and wrapped about the load, wherein the load is either rotated relative to a reciprocating film dispenser or a reciprocating film dispenser is orbited about a fixed load. Upon completion of the film wrapping operation and upon severing the film between the wrapped load and the film dispenser, it is known generally to subsequently weld or otherwise adhere the resulting overlapping film tail to an underlying film layer.

Some known apparatuses for welding, or thermally sealing, overlapping film layers wrapped about a load apply one or more flat surfaced heated pads against the wrapped load to compress overlapping film layers between the heated pads and the load, thereby at least partially melting the overlapping film layers, which forms a relatively permanent seal therebetween. A more sophisticated concept disclosed in U.S. Pat. No. 5,088,270, entitled "Film-Tail Heat Sealing System" issued on 18 Feb. 1992 and assigned commonly herewith, first stretches overlapping film layers away from the wrapped load prior to welding to permit heating and compressing the overlapping film layers from opposing sides thereof, thereby forming an improved weld. The apparatus of U.S. Pat. No. 5,088,270 utilizes the elasticity of the stretch film to stretch the film layers away from the load prior to welding and to subsequently return the welded film layers back toward the load tightly thereabout.

Prior art film welding apparatuses including those discussed above are usually located at or near the load wrapping station, and generally require that the wrapped load remain stationary during the welding operation, which must usually be performed over some specified time interval, or dwell time, to ensure complete welding. But delaying removal of the wrapped load from the load wrapping station, or stopping the wrapped load upon removal from the load wrapping station, to weld the film tail remaining after wrapping slows production. Additionally, the outer surface of many wrapped loads are not suitable for welding. More particularly, wrapped loads having non-planer surfaces or irregular shapes often do not provide adequate surface area against which the flat surfaced heated pads may be applied, thereby frustrating formation of a lasting weld. Also, it is generally costly to provide a thermal film sealing apparatus that will accommodate a wide range of load sizes.

An alternative to thermal film sealing apparatuses is a wiper member that wipes the severed film tail against the wrapped load, thereby adhering the film tail to the load by elastic and static electrical forces. In one known configuration, a nylon brush rotatably mounted on a pivotal support arm is positioned toward a moving wrapped load to adhere the film tail thereto as the load is conveyed away from the load wrapping station. This configuration does not require stopping the load to perform the sealing operation, since it is only necessary for the rotatable brush to wipe the film tail along side the wrapped load. Also, the pivotal arm has a relatively increased range of motion, or travel, so that the rotatable brush can accommodate an increased range of load sizes. Additionally, the rotatable brush is better able to conform to irregular load surfaces than heated pads, thereby providing improved film adherence. Film tails adhered by wiper type film sealer however have a tendency to separate from the load and unravel therefrom after a relatively short time, particularly when the load is subject to shipping and handling. Thus wiper type film sealers do not provide permanent film sealing treatment, as do heat sealers, but do provide improved film tail adherence to irregular shaped loads, at least for short time periods.

The present invention is directed toward novel advancements in the art of heated film sealers, and more particularly to novel rotary heat sealers and methods therefor for welding film tails to underlying film layers wrapped about a load.

It is therefore an object of the invention to provide a novel rotary heat sealer and method therefor that overcomes problems in the prior art, that is integratable with film wrapping systems or is useable as a stand-alone unit, and that is retrofittable in existing rotary brush film wiper systems.

It is a more particular object of the invention to provide a novel rotary beat sealer and method therefor useable for thermally sealing overlapping film layers wrapped about a load. The rotary heat sealer comprising a heat sealing disk having a peripherally disposed heating element disposed about a rotatable shaft, which is disposed through a central opening of the heat sealing disk, wherein the heat sealing disk is resiliently coupled to the rotatable shaft so that the heat sealing disk is rotatable with the shaft and the heat sealing disk is movable transversely relative to an axial dimension of the shaft, whereby the heating element is engageable with overlapping film layers wrapped about a stationary or moving load to thermally seal an overlapping film tail to underlying film layers.

It is also an object of the invention to provide a novel rotary heat sealer and method therefor as discussed above, wherein a plurality of heat sealing disks are spaced along the axial dimension of the rotatable shaft, the plurality of heat sealing disks rotatable with the rotatable shaft and independently movable transversely relative to the axis of the rotatable shaft as the heat sealing disks engage overlapping layers of film material wrapped about the load, thereby compensating for variations in the shape of the load to provide improved welding of overlapping film layers.

It is another object of the invention to provide a novel rotary heat sealer and method therefor as discussed above, wherein the heat sealing disks are coupled to the axis of the rotatable shaft by a plurality of spring members, each of the plurality of spring members having an inner end coupled to the rotatable shaft and an outer end extending substantially radially outwardly from the rotatable shaft, the outer end coupled to the heat sealing disk.

It is a further object of the invention to provide a novel rotary heat sealer and method therefor as described above, which is rotatably mounted on an outer end of a support arm having an inner end pivotally coupled to a relatively fixed support member, whereby the rotatable shaft and the heat sealing disk are pivotal toward and away from a load by extending and retracting a rod of an actuatable cylinder connected to the support arm.

These and other objects, features and advantages of the present invention will become more fully apparent upon careful consideration of the following Detailed Description of the Invention and the accompanying Drawings, which may be disproportionate for ease of understanding, wherein like structure and steps are referenced by corresponding numerals and indicators.

DETAILED DESCRIPTION OF THE INVENTION

Figure 1:
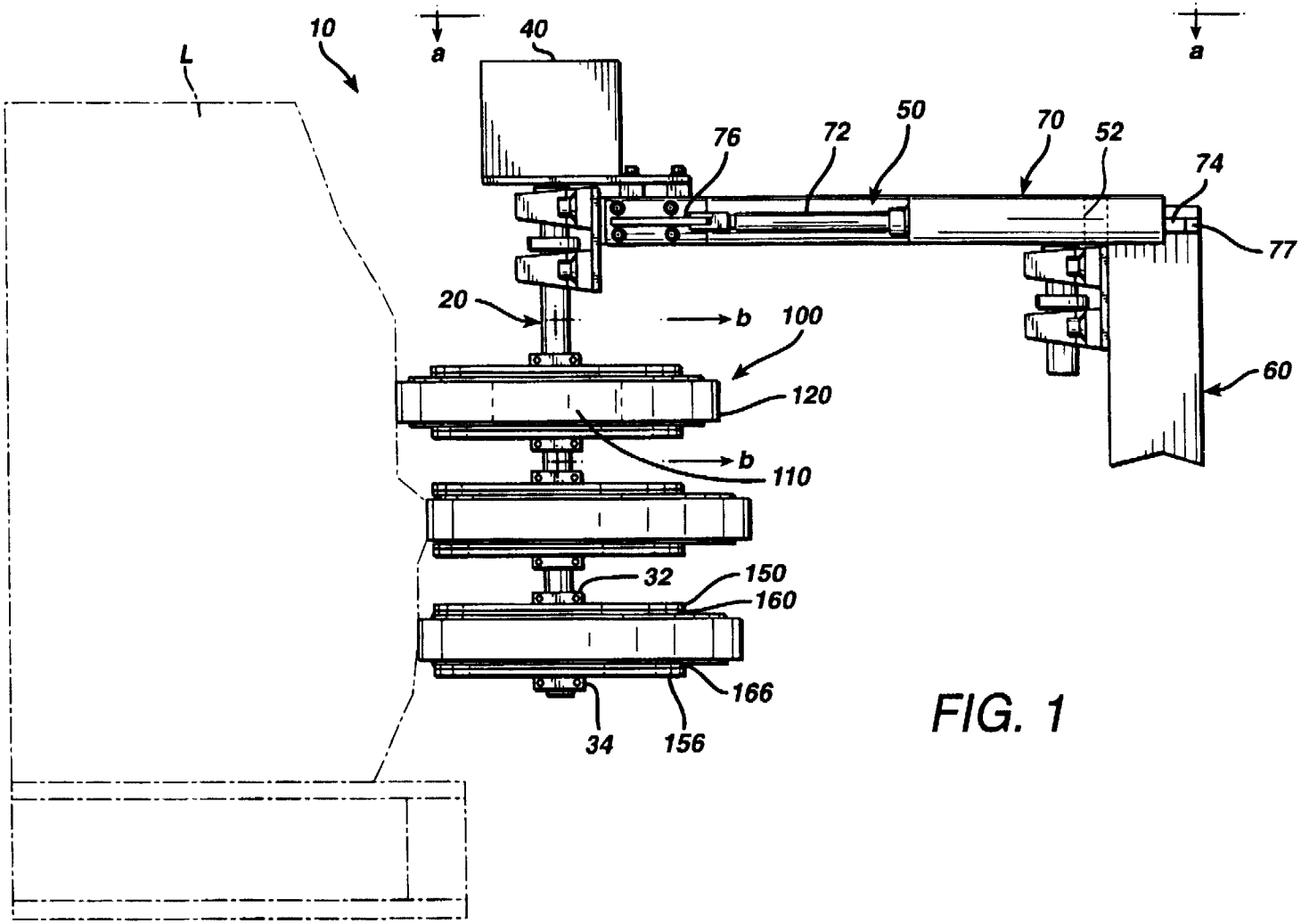
FIG. 1 is a partial side elevational view of a rotary heat sealer according to an exemplary embodiment of the invention.

FIG. 1 is a side elevational view of a rotary beat sealer 10 useable for thermally sealing, or welding, overlapping film layers wrapped about a load, and more particularly for welding an overlapping film tail to underlying film layers wrapped about the load. The rotary heat sealer 10 comprises generally one or more heat sealing disks 100 rotatably supported on a rotatable shaft 20 having an axial dimension.

The heat sealing disk 100 has generally a central opening 110 therethrough and a heating element 120 disposed on at least a portion of an outer peripheral surface thereof, wherein the rotatable shaft 20 is disposed through the central opening 110 of the heat sealing disk 100 so that the heating element 120 is disposed about the rotatable shaft. The heat sealing disk 100 is resiliently coupled to the rotatable shaft 20 so that the heat sealing disk 100 is movable transversely relative to the axial dimension of the rotatable shaft 20, and at the same time the heat sealing disk 100 is rotatable with the rotatable shaft 20, whereby the heat sealing disk is engageable with overlapping film layers wrapped about a load to weld overlapping film layers.

Figure 3:
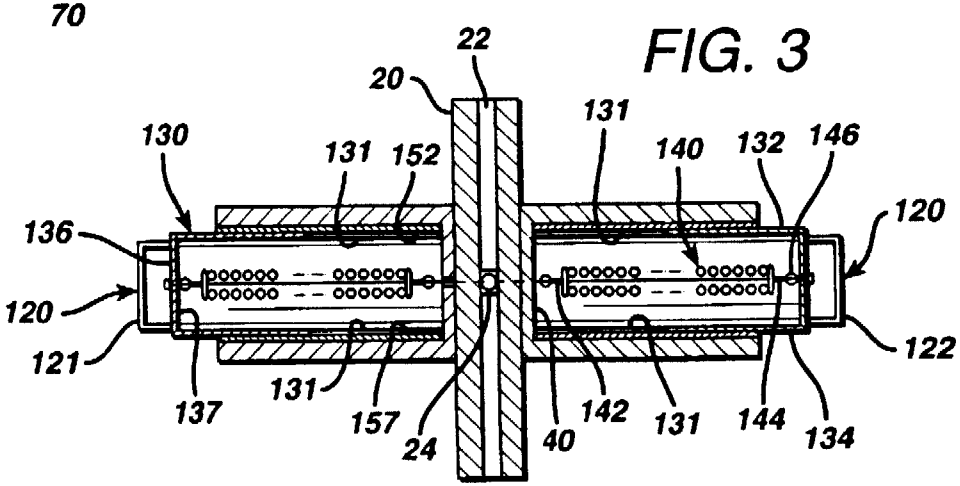
FIG. 3 is a partial sectional view along lines b–b of FIG. 1 illustrating in greater detail a portion of the rotary heat sealer.

FIG. 3 illustrates an exemplary heat sealing disk 100 comprising, more particularly, a support ring 130 having an upper surface 132, an opposing lower surface 134, an outer peripheral surface 136, and a central opening 131 between the upper surface 132 and the lower surface 134, wherein the central opening 131 defines an inner peripheral surface 137 of the support ring 130. The heating element 120 is disposed on the outer peripheral surface 134 of the support ring 130, wherein the rotatable shaft 20 is disposed through the central opening 131 of the support ring 130 so that the heating element 120 is disposed about the rotatable shaft 20.

In the exemplary embodiment, the support ring 130 is formed of aluminum, and the heating element 120 comprises one or more flexible heater strips formed of a foil element embedded in a heat conducting material, which is fastened to the outer peripheral surface 136 of the support ring 130 by an adhesive material like silicone glue. In the exemplary embodiment, two heating elements 121 and 122 are disposed on the outer peripheral surface 136 about the circumference of the support ring 130. Flexible heater strips suitable for this application are available from Minco Products, Model Nos. 18933 and 18934, one of which includes an integrated thermocouple, which is discussed further below.

The two heating elements 121 and 122 on each heat sealing disk 100 are electrically connected in series, and the heating elements 121 and 122 of the plurality of heat sealing disks 100 are electrically connected in parallel. FIG. 3 illustrates a hollowed axial portion 22 of the rotatable shaft 20 and corresponding radially disposed openings 24 for accommodating electrical power and thermocouple wiring for the heating elements 121 and 122 of each heat sealing disk 100, wherein the wiring is supplied to the rotatable shaft 20 through a commutator 40 located thereabove as shown in FIG. 1 to permit rotation of the rotatable shaft 20 as discussed further below. The thermocouple wiring is couplable to a programmable logic controller (PLC) which controls the temperature of the heating elements 120, which are thus maintainable at a relatively constant temperature, as is known generally. The heating elements 120 are selectively operable in a temperature range between approximately 230 degrees F. and approximately 320 degrees F., and in one application at approximately 285 degrees F.

The support ring 130 is resiliently coupled to the rotatable shaft 20 so that the heat sealing disk 100 is movable transversely relative to the axial dimension thereof, and at the same time the heat sealing disk 100 is rotatable with the rotatable shaft 20. FIG. 3 shows a plurality of spring members 140 coupling the heat sealing disk 100 to the rotatable shaft 20, wherein each of the plurality of spring members 140 has an inner end 142 coupled to the rotatable shaft 20, and an outer end 144 extending substantially radially outwardly from the rotatable shaft 20 and coupled to the heat sealing disk 100. The outer end 144 of the spring members 140 is more particularly coupled to the inner peripheral surface 137 of the support ring 130. In the exemplary embodiment, the spring member 140 is fastened to the support ring 130 and the rotatable shaft 20 by corresponding eye hooks 146 fastened to the support ring 130 and the rotatable shaft 20. According to this aspect of the invention, each heat sealing disk 100 is resiliently mounted to the rotatable shaft 20 and thus floats, or is movable transversely, relative to the axis of the rotatable shaft 20, whereby the spring members 140 bias the heat sealing disk 100 in a substantially concentric configuration relative to the rotatable shaft axis 20.

According to another aspect of the invention shown in FIGS. 1 and 3, an upper support member 150 is fixedly and substantially transversely coupled to the rotatable shaft 20, and a lower support member 156 is fixedly and substantially transversely coupled to the rotatable shaft 20 in spaced relation to the upper support member 150. In one embodiment, a lower surface 152 of the upper support member 150 is disposed toward an upper surface 132 of the heat sealing disk 100, and an upper surface 157 of the lower support member 156 is disposed toward a lower surface 134 of the heat sealing disk 100, whereby the heat sealing disk 100 is movable transversely between the upper and lower support members 150 and 156, which supportably guide the heat sealing disk 100 therebetween. In the exemplary embodiment, the upper and lower support members 150 and 156 are disk shaped members formed of a heat resistant epoxy glass material.

FIGS. 1 and 3 show the upper and lower support members 150 and 156 corresponding to each of the plurality of heat sealing disks 100 positioned axially along the rotatable shaft by corresponding split collar members 32 and 34 clamped about the rotatable shaft 20 adjacent an outer side 153 of the upper support member 150 and an outer side 158 of the lower support member 156. An annular bushing 40 with a wire opening aligned with opening 25 of the shaft 20 is disposed between the upper and lower support member 150 and 156 to maintain the support member 150 and 156 in spaced relation for accommodating the heat sealing disk 100 therebetween. FIGS. 1 and 3 show an upper thermally insulating member 160 disposed between the upper support member 150 and the upper surface 132 of the heat sealing disk 100, and a lower thermally insulating member 166 disposed between the lower support member 156 and the lower surface 134 of the heat sealing disk 100, thereby insulating the support members 150 and 156, retaining heat in the heat sealing member 100, and for operational safety. The exemplary upper and lower thermally insulating members 160 and 166 are disk shaped members formed of a heat resistant epoxy glass material.

Figure 2:
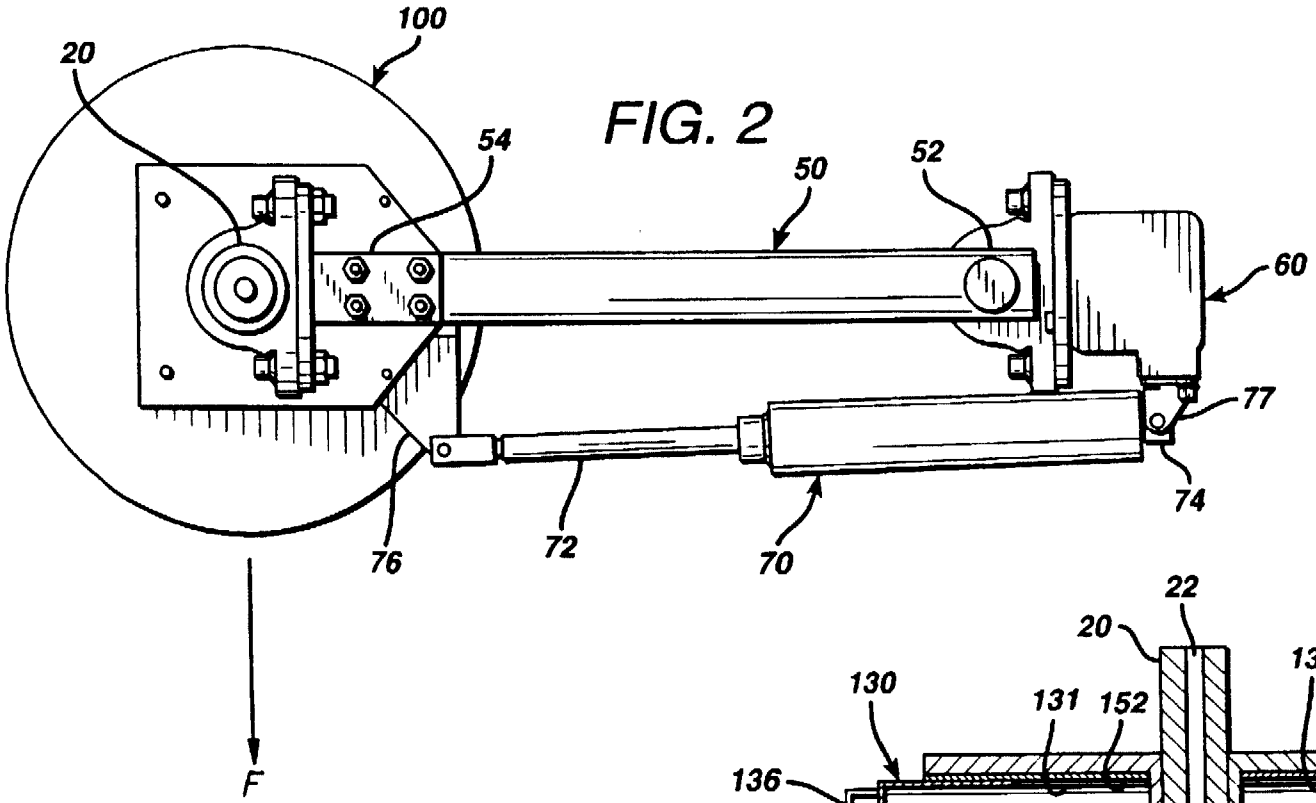
FIG. 2 is a top plan view along lines a–a of FIG. 1.

FIGS. 1 and 2 show a support arm 50 having an inner end 52 pivotally coupled to a fixed support member 60, and an outer end 54 coupled to and rotatably supporting the rotatable shaft 20. An actuatable cylinder 70 interconnects the support arm 50 and the fixed support member 60 for pivoting the support arm 50 about a pivoting member 53 at the inner end 52 thereof. The cylinder 70 includes more particularly an extendable and retractable rod 72 coupled to the support shaft 50 by a flange 76 mounted thereon toward the outer end 54, and an inner end 74 pivotally coupled to the fixed support member 60 by a flange 77. The actuatable cylinder 70 is, for example, a pneumatic cylinder available from Clippard, Model No. UDR-32-7B. FIG. 2 shows the rod 72 in the fully extended position and the support arm 50 at an end of its range of pivotal motion. FIG. 2 shows also that retracting rod 72 pivots the support arm 50 counterclockwise in the direction of arrow F, whereby the rotatable shaft 20 and the heat sealing disks 100 are movable toward and away from a load as the support arm 50 is pivoted upon extending and retracting the rod 72 of the actuatable cylinder 70. The pivoting support arm 50 configuration of FIGS. 1 and 2 has a relatively increased range of travel and thus accommodates a wide range of load sizes, and is relatively cost effective.

According to the operation of the exemplary embodiment, the rotary heat sealer 10 is positioned in the path of a moving wrapped load L as it is conveyed away from a load wrapping station so that the heat sealing disks, and more particularly the heating elements 120 thereof, engage the film tail overlapping underlying film layers wrapped about the load. FIG. 1 illustrates the plurality of heat sealing disks 100 rotatably supported by the rotatable shaft 20 disposed substantially vertically for engaging and welding overlapping film layers along a side portion of the wrapped load L, but in alternative applications the rotatable shaft 20 may be disposed substantially horizontally for engaging and welding overlapping film layers along a top, sides or bottom portion of a horizontally disposed cylindrical load. Actuation of the cylinder 70 may be controlled by a closed or open loop control system in response to sensed input signals. In one embodiment, a signal is generated upon detecting the presence of a moving load proximately approaching the rotary heat sealer 10 with an optical sensor or other detection means, whereby the rotary heat sealer 10 is moved toward the load to weld the load. The rotary heat sealer 10 may then be moved away from the welded load upon expiration of a timer or in response to a second sensed input signal generated as the welded load moves a distance past the rotary heat sealer 10.

The rotatable shaft 20 and the rotatable heat sealing disks 100 are freely rotatable as an integral assembly, which is rotatably driven by relative movement between the wrapped load and the heat sealing disks 100. Thus the wrapped load L may move relative to a translatably fixed but rotatable shaft 20 as shown in FIG. 1, or the rotatable shaft 20 may alternatively be translated relative to a fixed load. In the exemplary embodiment, the pneumatic pressure of the actuatable cylinder 70 is adjustable to maintain adequate contact pressure between the heat sealing disks 100 and the wrapped load, thereby ensuring rotation of the heat sealing disks 101 and permanent welding of overlapping film layers. In the exemplary embodiment, the path of the pivoting support arm 50 preferably opposes the path of the approaching wrapped load, and welding occurs as the load is conveyed past the rotary heat sealer 10 without interrupting conveyance of the load away from the load wrapping station.

FIG. 1 shows the plurality of heating elements 120 of the corresponding heat sealing disks 100 engaging overlapping film layers wrapped about the load L, wherein the plurality of heat sealing disks 100 and the rotatable shaft 20 rotate as the load is conveyed relative thereto. The number of heat sealing disks 100 disposed along rotatable shaft 20 is dictated by load size and welding requirements of the application. FIG. 1 also shows the heat sealing disks 100 independently movable transversely relative to the axis of the rotatable shaft 20 as the heat sealing disks 100 engage overlapping film layers wrapped about a relatively uneven or irregular side surface of the load L to compensate for variations in the shape of the load, whereby the heat sealing disks 100 assure complete and permanent welding of overlapping films layers.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A rotary heat sealer useable for welding overlapping film layers wrapped about a load, the rotary heat sealer comprising:

a rotatable shaft having an axial dimension;

a heat sealing disk having a central opening and a heating element disposed on at least a portion of an outer peripheral surface of the heat sealing disk;

the rotatable shaft disposed through the central opening of the heat sealing disk, the heating element disposed about the rotatable shaft, and the heat sealing disk resiliently coupled to the rotatable shaft, the heat sealing disk movable transversely relative to the axial dimension of the rotatable shaft, the heat sealing disk rotatable with the rotatable shaft, whereby the heating element of the heat sealing disk is engageable with overlapping film layers wrapped about a load to weld overlapping film layers.

2. The rotary heat sealer of claim 1 further comprising a plurality of at least two heat sealing disks, each heat sealing disk having a central opening and a heating element disposed on at least a portion of an outer peripheral surface of the heat sealing disk, the rotatable shaft disposed through the central opening of each heat sealing disk, the corresponding heating element disposed about the rotatable shaft, each heat sealing disk resiliently coupled to the rotatable shaft so that each heat sealing disk is independently movable transversely relative to the axial dimension of the rotatable shaft, each heat sealing disk rotatable with the rotatable shaft, the plurality of heat sealing disks spaced along the axial dimension of the rotatable shaft, whereby the plurality of heat sealing disks are engageable with overlapping film layers wrapped about a load to weld overlapping film layers.

3. The rotary heat sealer of claim 1 further comprising a plurality of spring members coupling the heat sealing disk to the rotatable shaft, each of the plurality of spring members having an inner end coupled to the rotatable shaft, and each of the plurality of spring members having an outer end extending substantially radially outwardly from the rotatable shaft, the outer end of the spring members coupled to the heat sealing disk.

4. The rotary heat sealer of claim 1 further comprising an upper support member axially fixed and substantially transversely coupled to the rotatable shaft, and a lower support member axially fixed and substantially transversely coupled to the rotatable shaft, the upper support member disposed proximate an upper surface of the heat sealing disk, and the lower support member disposed proximate a lower surface of the heat sealing disk, whereby the heat sealing disk is movable transversely between the upper and lower support members.

5. The rotary heat sealer of claim 4 further comprising an upper thermally insulating member disposed between the upper support member and the upper surface of the heat sealing disk, and a lower thermally insulating member disposed between the lower support member and the lower surface of the heat sealing disk.

6. The rotary heat sealer of claim 1, the heat sealing disk comprising:

a support ring having an upper surface, an opposing lower surface, an outer peripheral surface, and central opening between the upper surface and the lower surface, the central opening defining an inner peripheral surface of the support ring;

the heating element disposed on the outer peripheral surface of the support ring;

the rotatable shaft disposed through the central opening of the support ring so that the heating element is disposed about the rotatable shaft, the support ring resiliently coupled to the rotatable shaft so that the support ring is movable transversely relative to the axial dimension of the rotatable shaft, the support ring rotatable with the rotatable shaft.

7. The rotary heat sealer of claim 6 further comprising a plurality of spring members coupling the support ring to the rotatable shaft, each of the plurality of spring members having an inner end coupled to the rotatable shaft, and each of the plurality of spring members having an outer end extending substantially radially outwardly from the rotatable shaft, the outer end of the spring members coupled to the inner peripheral surface of the support ring.

8. The rotary heat sealer of claim 1 further comprising:

a support arm having an inner end and an outer end, the inner end of the support arm pivotally coupled to a relatively fixed support member, the rotatable shaft rotatably coupled to the outer end of the support arm; and an actuatable cylinder with an extendable and retractable rod, the cylinder pivotally coupled to the fixed support member, and the rod pivotally coupled toward the outer end of the support arm, whereby the rotatable shaft and the heat sealing disk are pivotal toward and away from a load having overlapping film layers upon extending and retracting the rod of the actuatable cylinder to weld the overlapping film layers.

9. The rotary heat sealer of claim 1 further comprising a thermocouple disposed in the heat sealing disk for indicating a temperature of the heat sealing disk.

10. A method of welding overlapping film layers wrapped about a load, the method comprising:

resiliently supporting a plurality of heat sealing disks along an axial dimension of a rotatable shaft, each heat sealing disk having a central opening and a heating element disposed on at least an outer peripheral surface of the heat sealing disk, the rotatable shaft disposed through the central openings of the heat sealing disks so that the heating elements are disposed about the rotatable shaft;

engaging overlapping film layers wrapped about the load with the corresponding heating elements of the plurality of heat sealing disks;

rotating the plurality of heat sealing disks with the rotatable shaft as the heat sealing disks engage the overlapping film layers wrapped about the load;

moving the heat sealing disks transversely relative to the axis of the rotatable shaft as the heat sealing disks engage overlapping film layers wrapped about the load to compensate for variations in the shape of the load, whereby the heat sealing disks weld overlapping films layer upon engaging the overlapping film layers.

11. The method of claim 10 further comprising resiliently coupling each of the heat sealing disks to the rotatable shaft with a corresponding plurality of spring members, each spring member having an inner end coupled to the rotatable shaft and an outer end extending substantially radially outwardly from the rotatable shaft and coupled to the heat sealing disk.

12. The method of claim 10 further comprising rotating the plurality of heat sealing disks with relative motion between the load and the plurality of heat sealing disks.

13. The method of claim 10 further comprising positioning the plurality of heat sealing disks toward and away from the load by actuating a cylinder having an extendable and retractable rod coupled to a support arm rotatably supporting the rotatable shaft.

* * * * *